US009943180B2

(12) United States Patent
Hsu

(10) Patent No.: US 9,943,180 B2
(45) **Date of Patent: *Apr. 17, 2018**

(54) TRAVEL PILLOW AND METHOD FOR STORING

(71) Applicant: OBEDO ENTERPRISES, INC., Vancouver (CA)

(72) Inventor: Gordon Hsu, Vancouver (CA)

(73) Assignee: OBEDO ENTERPRISES, INC., Vancouver, British Columbia (CA)

( * ) Notice: Subject to any disclaimer, the term of this patent is extended or adjusted under 35 U.S.C. 154(b) by 382 days.

This patent is subject to a terminal disclaimer.

(21) Appl. No.: 14/410,433

(22) PCT Filed: Mar. 5, 2014

(86) PCT No.: PCT/IB2014/059439

§ 371 (c)(1),
(2) Date: Dec. 22, 2014

(87) PCT Pub. No.: WO2015/015324

PCT Pub. Date: Feb. 5, 2015

(65) Prior Publication Data

US 2016/0270567 A1 Sep. 22, 2016

Related U.S. Application Data

(63) Continuation of application No. 14/096,644, filed on Dec. 4, 2013, now Pat. No. 9,186,003.

(Continued)

(51) Int. Cl.

*A47G 9/10* (2006.01)
*A47C 7/38* (2006.01)

(52) U.S. Cl.

CPC ..... *A47G 9/1081* (2013.01); *A47C 7/383* (2013.01); *A47G 2009/1018* (2013.01)

(58) Field of Classification Search

CPC ..... A47G 9/10; A47G 9/1009; A47G 2009/1018; A47G 9/1081; A47G 9/109; A47C 7/38; A47C 7/383

(Continued)

(56) References Cited

U.S. PATENT DOCUMENTS 924,893 A 6/1909 Doddridge
926,563 A 6/1909 Hobson (Continued)

FOREIGN PATENT DOCUMENTS

AU 2013206536 A1 10/2013
BR PI0609005 A2 1/2010

(Continued)

OTHER PUBLICATIONS

Mabis/DMI Cervical Dream Pillow on Amazon.com: http://www.amazon.com/Mabis-DMI-Healthcare-Cervical-Pillow/product-reviews/B000BHBYRK/ref=dp_db_cm_cr_acr_txt?ie=UTF8&showViewpoints=1.

(Continued)

*Primary Examiner* — Robert G Santos
(74) *Attorney, Agent, or Firm* — Revolution IP, PLLC

(57) ABSTRACT

A pillow for supporting the head and neck of a user has a tubular body, wherein the tubular body may include a first conical half and a second conical half. A depression is formed between the first conical half and the second conical half, the depression supporting a user's neck.

18 Claims, 17 Drawing Sheets

Related U.S. Application Data

(60) Provisional application No. 61/774,130, filed on Mar. 7, 2013.

(58) Field of Classification Search
USPC ..... 5/636, 640, 643–645
See application file for complete search history.

(56) References Cited

U.S. PATENT DOCUMENTS

| | | | | |
|---|---|---|---|---|
| 958,502 | A | 5/1910 | Kennedy | |
| 982,442 | A | 1/1911 | Rebhun | |
| 1,020,444 | A * | 3/1912 | Platt | A47G 9/10 5/636 |
| 1,274,595 | A | 8/1918 | Ranz | |
| 1,935,034 | A | 11/1933 | Charles | |
| 1,973,240 | A | 9/1934 | Proudfit et al. | |
| 3,242,511 | A | 3/1966 | Fultz et al. | |
| 3,258,790 | A | 7/1966 | Maru | |
| 3,263,246 | A | 8/1966 | Towery | |
| 3,521,310 | A * | 7/1970 | Greenawalt | A47G 9/10 5/636 |
| 3,698,023 | A | 10/1972 | Archbold | |
| 4,007,503 | A | 2/1977 | Watkin | |
| 4,081,870 | A | 4/1978 | Iannucci | |
| 5,138,732 | A | 8/1992 | Wattie et al. | |
| 5,148,564 | A | 9/1992 | Reder | |
| 5,239,717 | A | 8/1993 | Sue | |
| 5,440,769 | A | 8/1995 | Thomas | |
| 5,535,467 | A | 7/1996 | Ciske | |
| 5,535,468 | A | 7/1996 | Mallernee | |
| 5,572,753 | A | 11/1996 | Ruscitto | |
| 5,661,862 | A * | 9/1997 | Ryndak | A47G 9/10 5/636 |
| 5,689,844 | A * | 11/1997 | Liu | A47G 9/10 5/636 |
| D387,937 | S | 12/1997 | Pujals, Jr. | |
| 5,700,053 | A | 12/1997 | Downing | |
| D391,112 | S | 2/1998 | Houston | |
| 5,802,644 | A | 9/1998 | Scheurer | |
| 5,904,406 | A | 5/1999 | Stewart | |
| 5,907,876 | A | 6/1999 | Schwabe | |
| 5,920,933 | A | 7/1999 | Chou | |
| 5,992,939 | A | 11/1999 | Gass et al. | |
| 6,041,458 | A | 3/2000 | Vickers et al. | |
| 6,186,967 | B1 | 2/2001 | Messina | |
| 6,231,535 | B1 | 5/2001 | Mainiero et al. | |
| 6,381,786 | B1 | 5/2002 | Cadden | |
| 6,625,831 | B2 | 9/2003 | Laughlin | |
| 6,763,538 | B1 | 7/2004 | Tsai | |
| 6,895,619 | B1 | 5/2005 | Lee | |
| 6,951,038 | B1 | 10/2005 | Ganoe, Sr. | |
| 7,131,156 | B1 | 11/2006 | Walker-Craft | |
| 7,188,382 | B1 | 3/2007 | Taylor et al. | |
| 7,261,374 | B2 | 8/2007 | Potosky | |
| D580,695 | S | 11/2008 | Negrin | |
| 7,908,692 | B2 | 3/2011 | Lange | |
| 7,962,984 | B2 | 6/2011 | Popp | |
| 7,975,336 | B1 | 7/2011 | Perry | |
| 8,002,682 | B2 | 8/2011 | Dye | |
| D653,489 | S | 2/2012 | Perry | |
| 8,291,531 | B2 | 10/2012 | Kuo | |
| 8,607,391 | B2 | 12/2013 | Poppe | |
| 8,650,683 | B2 * | 2/2014 | Parnham | A47G 9/1081 5/636 |
| 8,708,416 | B2 | 4/2014 | Stronconi | |
| 9,186,003 | B2 * | 11/2015 | Hsu | A47G 9/10 |
| 2006/0021147 | A1 | 2/2006 | Inaba | |
| 2006/0200910 | A1 | 9/2006 | Taylor | |
| 2009/0211032 | A1 | 8/2009 | Lange | |
| 2010/0043147 | A1 | 2/2010 | Popp | |
| 2013/0031723 | A1 * | 2/2013 | Parnham | A47G 9/1081 5/645 |
| 2015/0150391 | A1 * | 6/2015 | Hsu | A47G 9/10 5/636 |
| 2015/0157130 | A1 * | 6/2015 | Kellock | A47C 7/383 5/636 |
| 2015/0282647 | A1 * | 10/2015 | Hall | A47G 9/10 5/636 |
| 2016/0270567 | A1 * | 9/2016 | Hsu | A47G 9/1081 |

FOREIGN PATENT DOCUMENTS

| | | | |
|---|---|---|---|
| CA | 2600812 | A1 | 9/2006 |
| CA | 2630424 | A1 | 11/2009 |
| CA | 2600812 | C | 1/2013 |
| CN | 101166446 | A | 4/2008 |
| CN | 201504911 | U | 6/2010 |
| CN | 201668170 | U | 12/2010 |
| CN | 102058295 | A | 5/2011 |
| CN | 101166446 | B | 5/2012 |
| CN | 203137802 | U | 8/2013 |
| DE | 29802 349 01 | | 6/1998 |
| EP | 1700544 | A1 | 9/2006 |
| EP | 1898749 | A1 | 3/2008 |
| JP | 2005-21230 | A | 1/2005 |
| JP | 2008532595 | A | 8/2008 |
| JP | 2011-30593 | A | 2/2011 |
| JP | 2011-244990 | A | 12/2011 |
| JP | 5047155 | B2 | 10/2012 |
| MX | 2007011068 | A | 2/2008 |
| RU | 2007137657 | A | 4/2009 |
| RU | 2395223 | C2 | 7/2010 |
| WO | 2006094509 | A1 | 9/2006 |

OTHER PUBLICATIONS

Neckii, website, http://www.neckii.com/.

International Search Report and Written Opinion of the International Searching Authority in related PCT application No. PCT/IB2014/059439.

Cervical Dream Pillow https://shop.briggscorp.com/e2wItemMain.aspx?parentId=IT00006097.

Duro-Med Cervical Contour Pillow http://www.amazon.ca/DMI-554-8024-1900-Duro-Med-Cervical-Contour/dp/B0009STNBO/ref=sr_1_1?ie=UTF8&qid=1424471585&sr=8-1&keywords=duro+med+cervical+contour.

* cited by examiner

TRAVEL PILLOW AND METHOD FOR STORING

THE FIELD OF THE INVENTION

This invention relates generally to a pillow, and, more particularly, to a travel pillow which is compact for easy storage when not in use but which may be easily assembled to provide neck and spine support when travelling and or sleeping.

BACKGROUND

Travelers are often forced to sit for extended periods of time in an upright posture when traveling in planes, cars, buses, trains or when using other modes of travel. Traveling or otherwise sitting in an upright position without adequate back or neck support may result in discomfort, pain, or potentially lead to poor back or neck health. A number of different types of neck support pillows have been developed in the past to address concerns regarding neck support. Neck support pillows currently available often attempt to minimize hinging of the neck that might occur when a person nods off to sleep. Currently available neck support pillows may also attempt to fill in the gap directly between the neck and the chair to provide neck support and assist a person to relax when seated in a confined space. In general, neck support pillows are commonly horseshoe-shaped collars which fit around the neck of the user and rest on the user's shoulders to support the back of the neck and prevent the head from tilting sharply to one side or the other.

In the past, there have been two primary types of horseshoe-shaped neck support pillows: neck pillows pre-filled with stuffing or filling material and inflatable neck pillows. Inflatable neck support pillows are often compact when uninflated and allow the user to easily store the uninflated neck pillow in the user's luggage until needed by the user. When the user wants to use the inflatable type of neck pillow, he or she may be required to remove the inflatable neck support pillow from the user's luggage and then inflate it prior to use.

One disadvantage of an inflatable neck support pillow is that it may require the user to spend several minutes blowing or breathing air into an air way disposed in the inflatable neck support pillow. This can be both time consuming and exhausting to many users.

Further, if the inflatable neck support pillow is not adequately or properly inflated, it may not provide proper or sufficient support. If the neck support pillow is overinflated, the support may be too stiff. If the neck support pillow is underinflated, the support may be insufficient.

Additionally, plastic material commonly used to form an inflatable support pillow's air bladder is not generally breathable and may cause the user to sweat or retain heat on or around the back of the user's neck during use.

Pre-filled horseshoe-shaped neck support pillows may include shredded foam filling, feathers, or organic granular or bark-type materials as pillow stuffing. One disadvantage of a pre-filled neck support pillow is that it may push the neck too far forward or not forward enough, which may dispose the head and neck in an uncomfortable position and could result in poor neck health. A pre-filled neck support pillow may not be responsive to the differing preferences of user's with respect to pillow firmness and neck position.

Another disadvantage of a pre-filled neck support pillow is that it may embody a large footprint and when packed in the user's luggage may utilize a significant amount of luggage space. A pre-filled horseshoe-shaped neck support pillows may encompass up to approximately one-third (⅓) of the storage space in a piece of carry-on luggage.

Restrictive airline constraints on carry-on luggage sizes may also increase the importance that travelers place on the portability and size of neck support pillows when purchasing or otherwise selecting a neck support device. Further, a pre-filled horseshoe-shaped neck support pillow becomes a burden to store or carry around after a user completes his or her travels because of the weight and size.

Thus, it is desirable to have an improved neck support pillow that is light, breathable, provides responsive neck support, has a small footprint, and stores easily. It is also desirable to have an improved method for storing a neck support pillow.

SUMMARY OF INVENTION

It is an object of the present invention to provide an improved neck support pillow. It is also an object of the present invention to provide an improved method for storing a neck support pillow.

In one or more aspects of the present invention, a neck support pillow for supporting the head and neck of a user is provided. The neck support pillow may be comprised of a single continuous support pillow body. The support pillow body may be substantially tubular. The substantially tubular pillow shaped body may be substantially hour glass in shape or may be substantially cylindrical in shape. The substantially tubular support pillow body may be comprised of a first conical half and a second conical half. A depression may be formed between the first conical half and the second conical half, wherein the depression may support a user's neck.

In one or more aspects of the present invention, the substantially tubular support pillow body may be comprised of a flexible foam shell or other elastic polymer based shell. The foam material may be made of rubber, elastic polymer, polyurethane, or man-made or natural based material that is flexible in nature. Other flexible materials, such as other polymer or composite material, may also be used to make the support pillow body. The thickness of the foam support pillow body shell may vary to adjust compression, support, and comfort levels. The firmness of the foam material comprising the support pillow body may also vary to adjust compression, support, and comfort levels.

In another aspect of the present invention, a foam support pillow body shell may be thinner in a center region to decrease resistance and permit increased compression of the support pillow body in the region in which a user disposes his or her neck. In another aspect of the present invention, a foam shell of a support pillow body may be thicker at first and second end regions to increase resistance and reduce compression of the support pillow body in the regions that may be used to support a first and second side of a user's neck and or head.

In another aspect of the present invention, a foam support pillow body shell may be comprised of a less dense foam material in a center region to reduce resistance and permit increased compression of the support pillow body in the region in which a user disposes his or her neck. In another aspect of the present invention, a foam support pillow body shell may be comprised of greater density foam material at first and second end regions to increase resistance and reduce compression of the support pillow body in the regions that may be used to support a first and second side of a user's neck and or head.

In another aspect of the present invention, a support pillow body shell may be comprised of a softer foam material in a center region to reduce resistance and permit increased compression of the support pillow body in the region in which a user disposes his or her neck. In another aspect of the present invention, a support pillow body shell may be comprised of firmer foam material at first and second end regions to increase resistance and reduce compression of the support pillow body in the regions that may be used to support a first and second side of a user's neck and or head.

In yet another aspect of the present invention, a foam support pillow body shell may be comprised of a flexible foam material having substantially the same density and thickness throughout the support pillow body shell. The support pillow body having substantially the same thickness and density of foam throughout may be capable of being assembled into a substantially hourglass shape.

In one or more aspects of the present invention, the neck support pillow may be disassembled into a substantially planar body comprising a substantially rectangular shape. The substantially planar body may be folded and secured in a folded position using a flap suitable for securing the planar body in a folded position.

The neck support pillow may be assembled by unfolding the substantially rectangular planar body and fastening a first edge of the planar body to a corresponding and opposite second edge of the planar body. When assembled, the depression in the central region of the neck support pillow for supporting a user's neck may be disposed in the support pillow body between the first conical half and the second conical half so as to form a substantially hour glass shape.

The support pillow body may be comprised of a single cast body or of a plurality of cast pieces, such as two conical pieces separately caste and fastened together to form a substantially hourglass-shaped support pillow body. The support pillow body may be comprised of a flexible foam having a plurality of parallel flexible cords or rods integrated within the foam and disposed along the length or along the width of the substantially planar body comprising the support pillow body. The rigidity or firmness of the plurality of parallel flexible cords or rods may be increased or decreased to increase or decrease resistance of the support pillow body or to increase or decrease the flexibility in the shape of the neck support pillow. The cords or rods may be made of foam material, which may be made of rubber, elastic polymer, polyurethane, or man-made or natural based material that is flexible in nature. Other flexible materials suitable for increasing resistance may also be used.

A fastening device may be used to help maintain the support pillow body in a tubular structure form. A collar member may also be secured around the support pillow body at one or more positions to help maintain the support pillow body in a tubular structure form.

These and other aspects of the present invention are realized in a neck support pillow and method for storing the same as shown and described in the following figures and related description. Additional objects, features, and advantages of the present invention will be set forth in the detailed description and accompanying drawings that follow, which together illustrate by way of example, the features of the invention.

BRIEF DESCRIPTION OF DRAWINGS

Various embodiments of the present invention are shown and described in reference to the numbered drawings wherein.

Figure 1A:
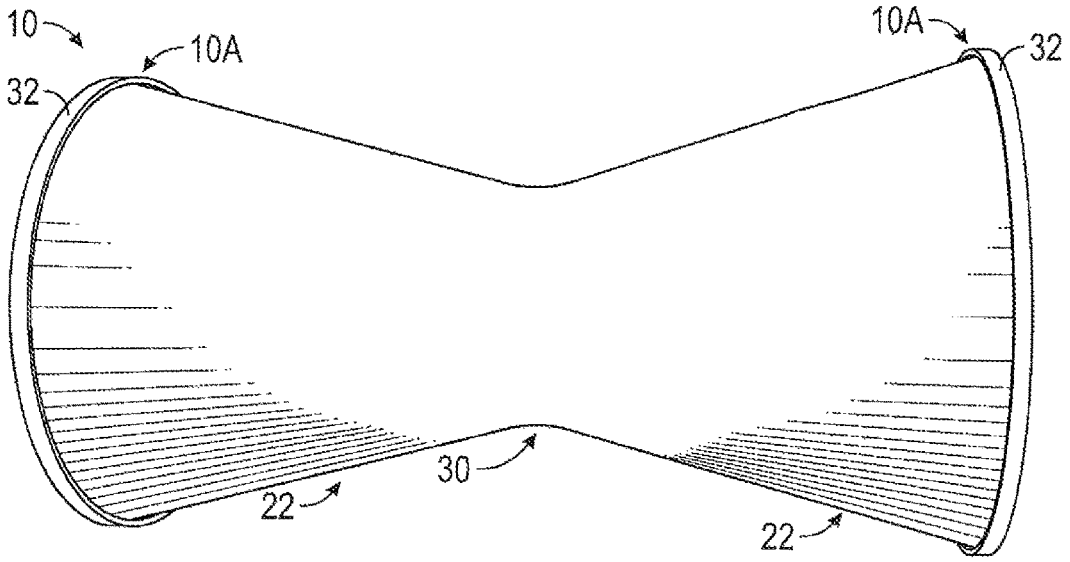
FIG. 1A is a perspective view of a neck support pillow in accordance with one or more aspects of the present invention.

It will be appreciated that the drawings are illustrative and not limiting of the scope of the invention which is defined by the appended claims. The drawing figures are not necessarily drawn to scale and certain figures may be shown in exaggerated or generalized form in the interest of clarity and conciseness. The embodiments shown accomplish various aspects and objects of the invention. It is appreciated that it is not possible to clearly show each element and aspect of the invention in a single figure, and as such, multiple figures are presented to separately illustrate the various details of the invention in greater clarity. Similarly, not every embodiment need accomplish all advantages of the present invention.

DETAILED DESCRIPTION

The description set forth below in connection with the appended drawings is intended as a description of presently preferred embodiments of the application and is not intended to represent the only forms in which the present invention can be constructed and or utilized. The description sets forth the functions and the sequence of steps for constructing and operating the application in connection with the illustrated embodiments. It is to be understood, however, that the same or equivalent functions and sequences may be accomplished by different embodiments that are also intended to be encompassed within the spirit and scope of this application. For instance, a similar embodiment may be used for a back support pillow.

The invention and accompanying drawings will now be discussed so as to enable one skilled in the art to practice the present invention. The drawings and descriptions are exemplary of various aspects of the invention and are not intended to narrow the scope of the appended claims.

Turning now to FIGS. 1A, 3, 5, 7, 9A, 10, 13, and 15, a neck support pillow 10 is disclosed in accordance with one or more aspects of the present invention. The neck support pillow 10 may be comprised of a support pillow body 12. The support pillow body 12 may be configured to any number of shapes as shown in FIGS. 4A through 4F. The support pillow body may be made of foam. The foam material may be made of rubber, elastic polymer, polyurethane, or man-made or natural based material that is flexible in nature. The support pillow body may also be made of other flexible materials, such as polymers or composites, including soft plastic, or rubber. In a preferred embodiment, the support pillow body 12 may be made using injection or foam molding. Liquid foam may be poured or otherwise dispensed into a mold having a shape substantially in one of the shapes shown in FIGS. 4A through 4F. The liquid foam may expand within the mold so as to create a hollow or tubular foam body having an outer shape substantially in one of the shapes shown in FIGS. 4A through 4F. The hollow or tubular foam body may be cut or severed longitudinally to allow the support pillow body 12 to be unrolled into a substantially planar body having a substantially rectangular shape or a substantially flattened hour glass shape.

Figure 3:
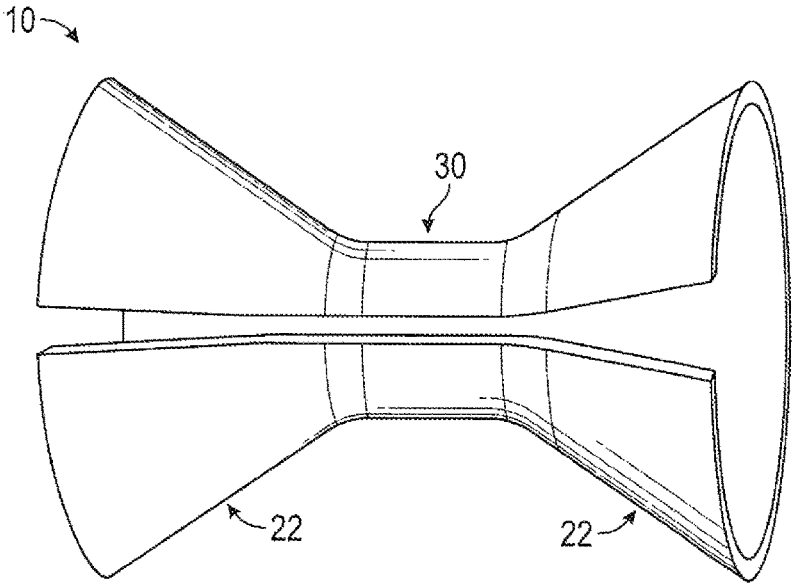
FIG. 3 is a perspective view of a neck support pillow in accordance with one or more aspects of the present invention showing a longitudinal opening to permit unrolling and folding of the neck support pillow for storage.

The shape of the support pillow body 12 may affect the shape of the neck support pillow 10. In accordance with one or more embodiments of the present invention, the support pillow body 12 may be configured so that it is shaped substantially as a pair of trapezoidal halves when the neck support pillow is unassembled. The trapezoidal halves may be symmetrical as shown in FIG. 3. However, asymmetrical halves may also be used without departing from the spirit and scope of the present invention.

One or more fastening mechanisms may be disposed along first and second edges of the support pillow body 12 where the support pillow body 12 has been severed to permit temporary fastening and unfastening of the two edges. The temporary fastening mechanism 16 may be a zipper mechanism, or it may include alternative temporary fasteners such as hook and loop fasteners, buttons, or snaps may be used to fasten the said first and second edges of the support pillow body 12. Alternatively, the support pillow body 12 may include integrated male and female connectors on the first and second connecting edges of the support pillow body.

Figure 16:
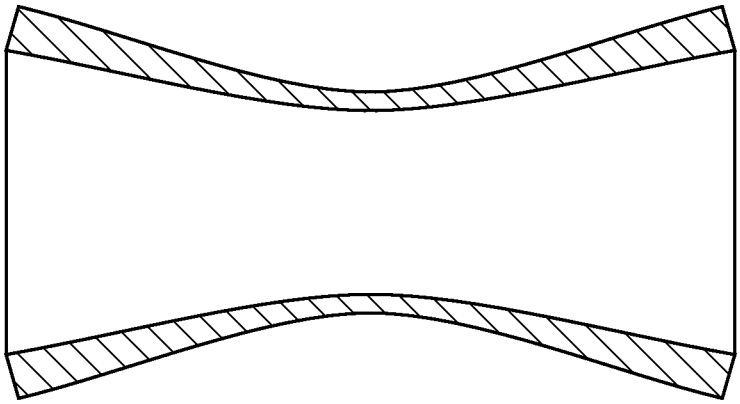
FIG. 16 is a cutaway view of a support pillow body in accordance with one or more aspects of the present invention.
Figure 17:
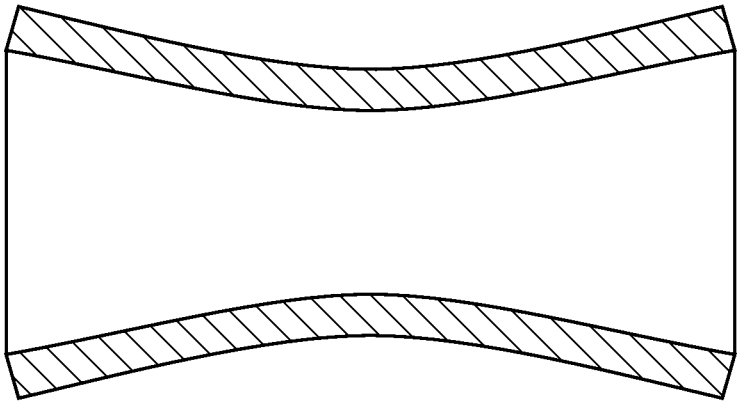
FIG. 17 is a cutaway view of a support pillow body in accordance with one or more aspects of the present invention.
Figure 18:
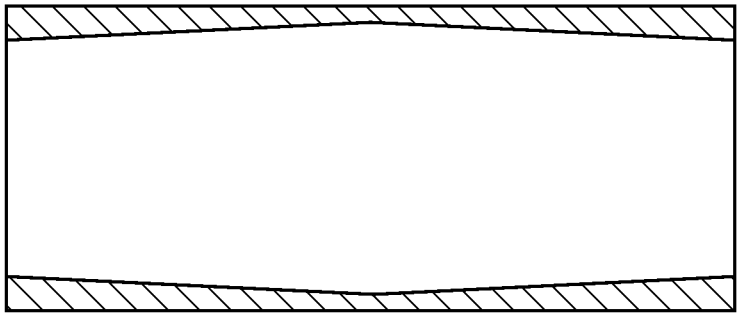
FIG. 18 is a cutaway view of a support pillow body in accordance with one or more aspects of the present invention.
Figure 19:
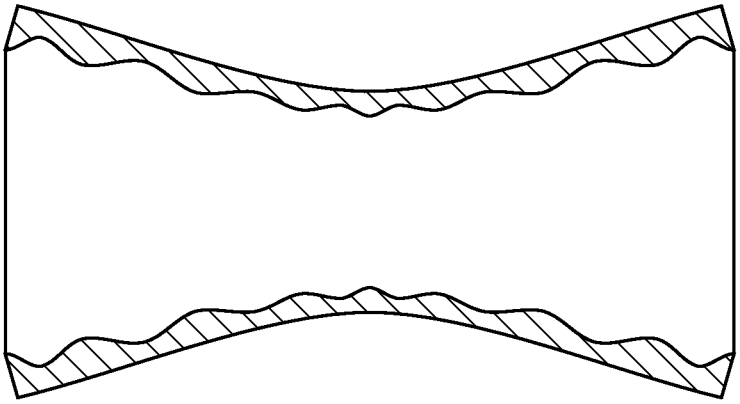
FIG. 19 is a cutaway view of a support pillow body in accordance with one or more aspects of the present invention.
Figure 20:
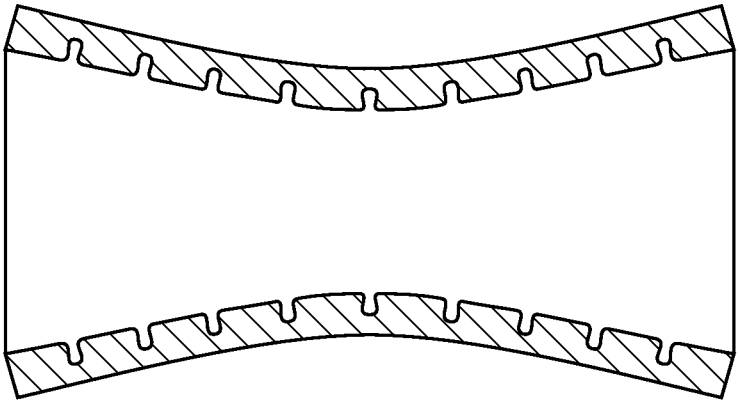
FIG. 20 is a cutaway view of a support pillow body in accordance with one or more aspects of the present invention.

As shown in FIGS. 16, 17, and 18, the foam shell comprising the support pillow body 12 may be thinner near a center region to decrease resistance and permit increased compression of the support pillow body near the region where a user disposes his or her neck. The foam shell of the support pillow body 12 may be thicker near first and second end regions to increase resistance and reduce compression of the support pillow body near the regions that may be used to support a first and second side of a user's neck and or head.

Alternatively, the foam shell of the support pillow body 12 may be comprised of a less dense foam material near a center region to reduce resistance and permit increased compression of the support pillow body 12 near the region where a user disposes his or her neck. The foam shell of the support pillow body 12 may be comprised of greater density foam material near first and second end regions to increase resistance and reduce compression of the support pillow body 12 near the regions that may be used to support a first and second side of a user's neck and or head.

A foam shell of a support body 12 may also be comprised of a softer foam material near a center region to reduce resistance and permit increased compression of the support pillow body 12 near the region in which a user disposes his or her neck. The foam shell of the support pillow body 12 may be comprised of firmer foam material near first and second end regions to increase resistance and reduce compression of the support pillow body near the regions that may be used to support a first and second side of a user's neck and or head.

The foam shell of the support pillow body 12 may also be comprised of a flexible foam material having substantially the same density and thickness throughout the support pillow body 12, wherein other means for increasing or decreasing the resistance to compression across the support pillow body may be provided.

Resistance, compression, support, and comfort levels of the neck support pillow 10 may be adjusted based on the shape, thickness, density, and firmness of the support pillow body 12 and of the foam comprising the support pillow body. Other mechanism for managing or regulating compression or resistance in the neck support pillow 10 of the present invention may also be provided. Of course, air pockets, filling, or heating or cooling or vibrating mechanisms may also be included without departing from the spirit and scope of the present invention.

Figure 1B:
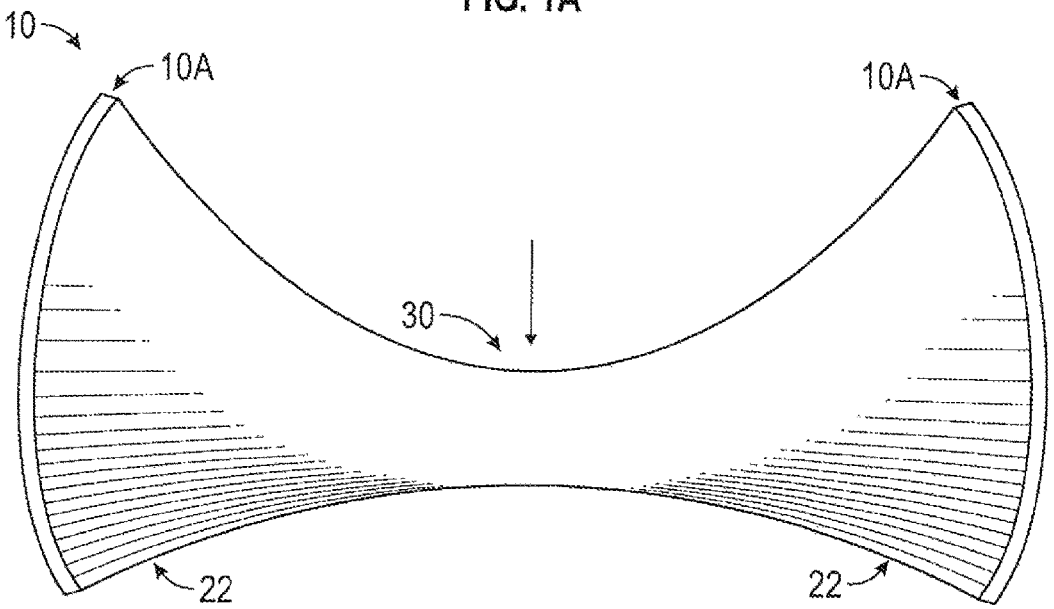
FIG. 1B is a perspective view of the neck support pillow of FIG. 1A showing slight compression on a center region of the neck pillow such as may be levied by the weight of a user's neck.
Figure 2:
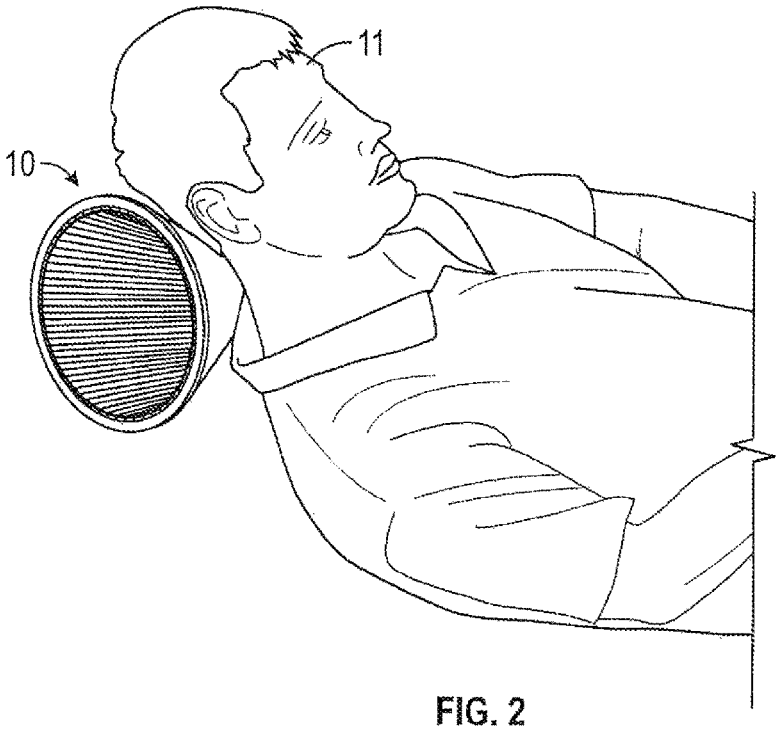
FIG. 2 is a perspective view of a neck support pillow being use by an individual in accordance with one or more aspects of the present invention.

Referring now to FIGS. 1 through 3, a neck support pillow 10 in accordance with one or more aspects of the present invention is disclosed. When assembled, the neck support pillow 10 may be hollow or tubular. The neck support pillow 10 may be configured substantially in the form of a pair of conical halves 22 wherein the two conical halves are attached so that the neck support pillow 10 is configured in a substantially hourglass—shape as shown in the Figures. In one or more embodiments of the present invention, a depression 30 may be disposed between the pair of conical halves 22 near the center region of the neck support pillow 10. A user may rest his or her neck in the depression 30 as shown in FIG. 2. The expanding nature of the conical halves 22 may be used to support the side leaning tendencies of a head of a user while seated in a slightly reclined or reclined manner.

As shown in FIG. 1B, when pressure is exerted in a direction perpendicular to the neck support pillow 10, such as when a user 11 rests his or her neck in the depression 30, the support pillow body 12 may compress the first and second ends 10A of the neck support pillow 10 may move laterally inward toward the center region of the neck support pillow 10, e.g., towards the center of the depression 30 for supporting the user's neck. Movement of the first and second ends 10A of the neck support pillow towards the center of the neck support pillow may help provide improved comfort and support for a user's neck and head by providing for a snugger fit of the neck support pillow around the user's neck and head and may be used to mitigate the side leaning tendencies of a head of a user while seated in a reclined position.

The neck support pillow 10 shown in FIGS. 1-3 may also be comprised of other shapes as previously shown in FIGS. 4A through 4F. Each of the configurations shown in FIGS. 4A through 4E may include a depression 30 and first and second raised ends 10A.

Figure 4A:
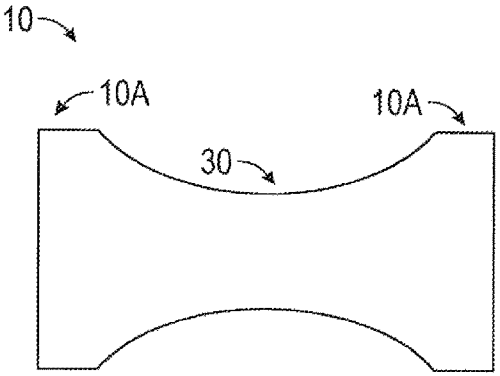
FIGS. 4A through 4F show various possible shape configurations for an assembled neck support pillow in accordance with one or more aspects of the present invention.
Figure 4B:
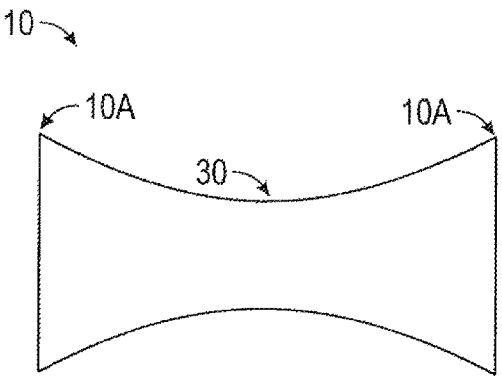
Figure 4C:
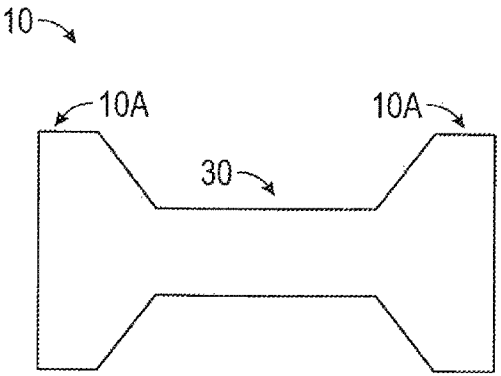
Figure 4D:
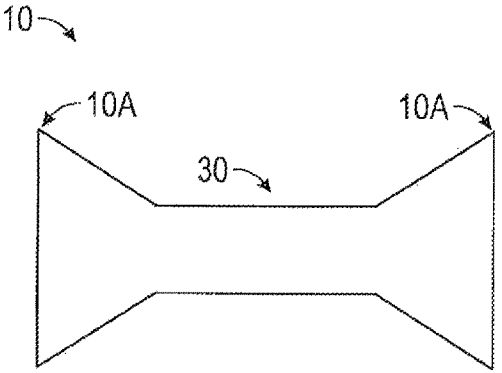
Figure 4E:
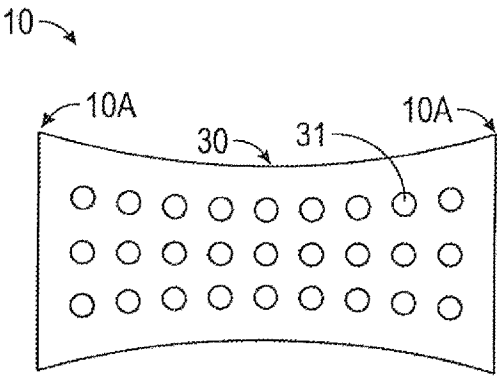
Figure 4F:
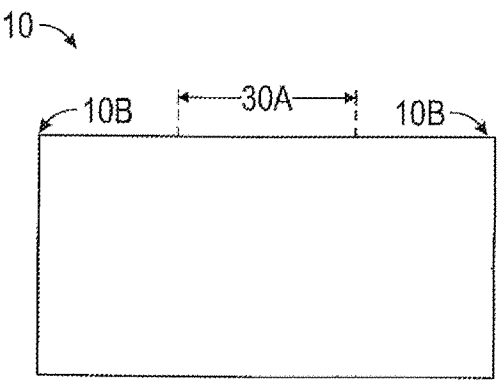
Figure 5:
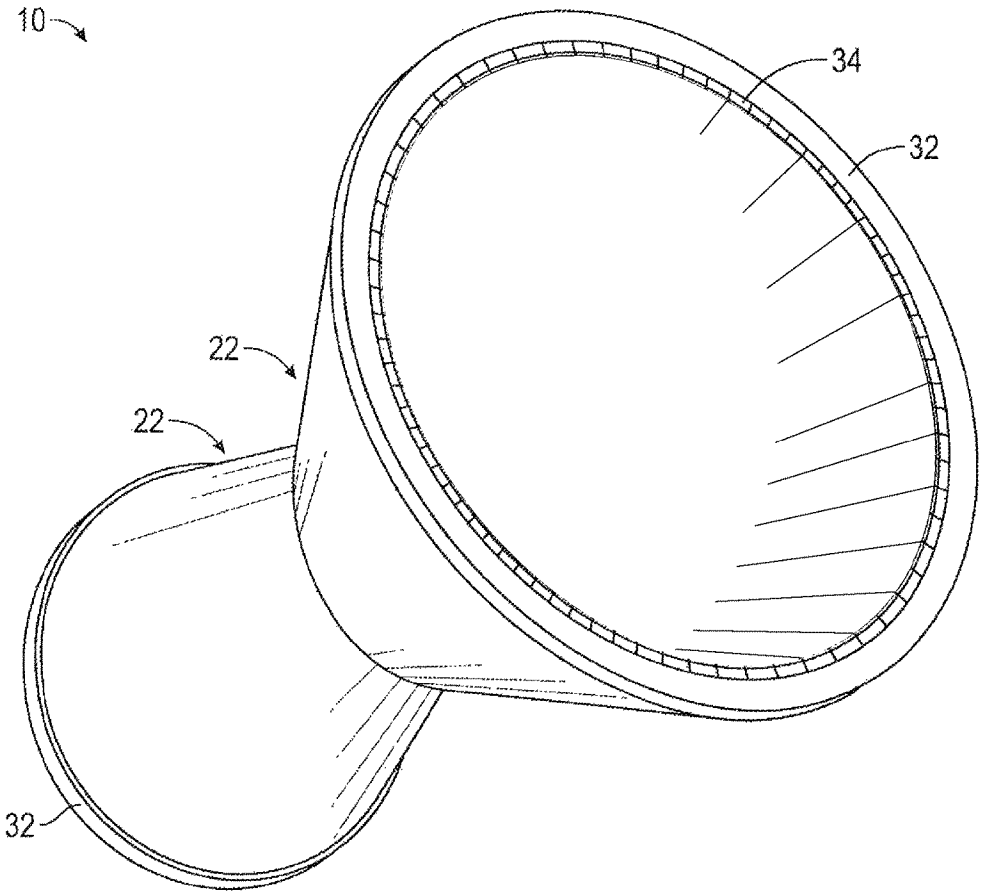
FIG. 5 is an end perspective view of a neck support pillow in accordance with one or more aspects of the present invention.

A neck support pillow 10 having a cylindrical shape as shown in FIG. 4F may also be configured to improve neck support when a user exerts perpendicular pressure with his or her neck against a center region 30A of the neck support pillow 10. As shown in FIG. 17, a cylindrical neck support pillow 10 may be configured so that the hollow interior is in the shape of an hourglass wherein the shell or wall of the support pillow body 12 is thinner near the center region 30A and thicker near the first and second ends 10B of the neck support pillow 10. Alternatively, a neck support pillow 10 having a cylindrical shape as shown in FIG. 4F may be comprised at the center region 30A of a softer or less dense flexible foam material and comprised at the first and second ends 10B of a firmer or more dense flexible foam material by comparison of the center region 30A and the regions near the first and second ends. Thus, when a user exerts presser to the center region 30A by disposing his or her neck thereon, the center area 30A sinks inward and the ends 10B of the neck support pillow 10 may move slightly inward and may be used to support the side leaning tendencies of a head of a user while seated in a slightly reclined or reclined position.

It should be noted that the configurations shown in FIGS. 4A through 4F should not be seen as limiting the configuration of the present invention. Other configurations may be used without departing from the spirit and scope of the present invention. For example, while the neck support pillow 10 shown in FIGS. 4A through 4F may appear symmetrical in design, the neck support pillow 10 may include asymmetrical shaped embodiments.

As disclosed supra, the neck support pillow 10 may be formed of a single continuous support pillow body 12 made of foam. The foam material may be made of rubber, elastic polymer, polyurethane, or man-made or natural based material that is flexible in nature. The support pillow body may also be made of other flexible materials, such as flexible polymers or composites. As shown in in FIGS. 8AA and 8AB, the support pillow body may include ribs to improve resistance and support. The ribs may be made of a foam material, which may be made of may be made of rubber, elastic polymer, polyurethane, or man-made or natural based material that is flexible in nature. The ribs may also be made of other flexible materials, such as composites or polymers, including rubber or soft plastic. The ribs may be flexible and more or less rigid depending on the level of tension or resistance desired.

Figure 8A:
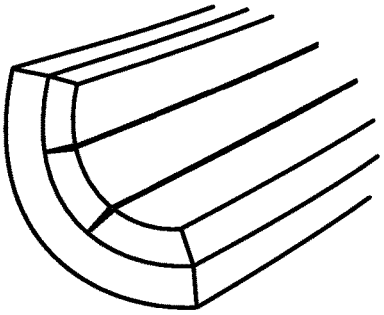
FIGS. 8AA and 8AB are magnified cutaway views of a section of a support pillow body having a ribbed configuration in accordance with one or more aspects of the present invention.
Figure 8A:
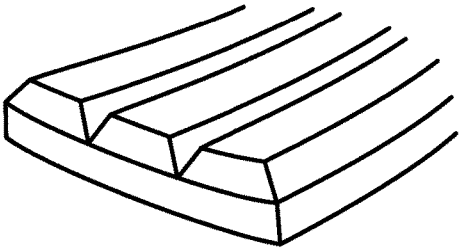
Figure 8B:
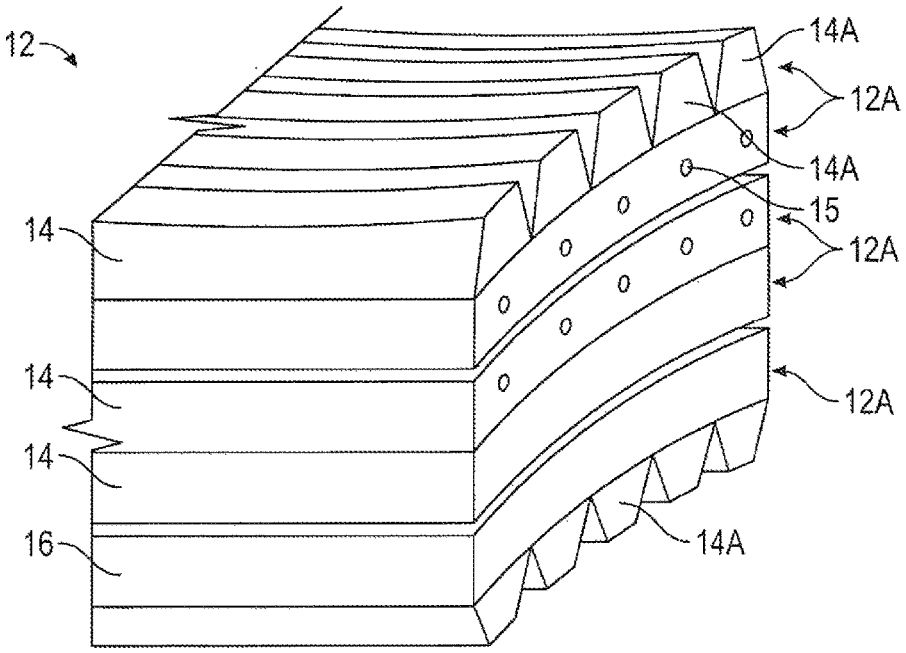
FIG. 8B is a magnified cutaway view of another embodiment of the present invention having a support pillow body including a ribbed configuration in accordance with one or more aspects of the present invention.

As shown in FIG. 8B, the support pillow body 12 may be comprised of one or more different layers. For example, FIG. 3 shows that the neck support pillow 10 is formed of a support pillow body 12 made of a single layer. The support pillow body 12 may not include ribs, as shown in FIG. 3. In accordance with one or more other embodiments of the present invention, the support pillow body 12 may be comprised of a plurality of layers 12A as shown in FIGS. 8AA, through 8B. For example, as shown in FIG. 8B, the support pillow body 12 may be comprised of one or more hard foam layers 14. A softer foam layer 16 may be positioned on exposed sides of the neck support pillow 10. Each of the plurality of layers 12A may be of different density or firmness and a variety of layer positions (e.g., outer cone shapes may comprise harder layers while inner cylinder section may be comparatively softer) and these varying designs may allow the product to provide for varying comfort and support in response to compression or pressure from the neck or head of a user.

As shown in FIGS. 8AA through 8C, the layers 14 may be formed of a plurality of ribs or strips 14A. The ribs or strips 14A may be comprised of foam, which foam material may be made of rubber, elastic polymer, polyurethane, or man-made or natural based material that is flexible in nature. In the embodiment shown, each of the plurality of strips 14A may be trapezoidal in shape. Thus, when the neck support pillow 10 is rolled and assembled, the trapezoidal shape of the plurality of strips 14A press against each other as shown in FIGS. 8AA and 8C to provide additional support.

Figure 8C:
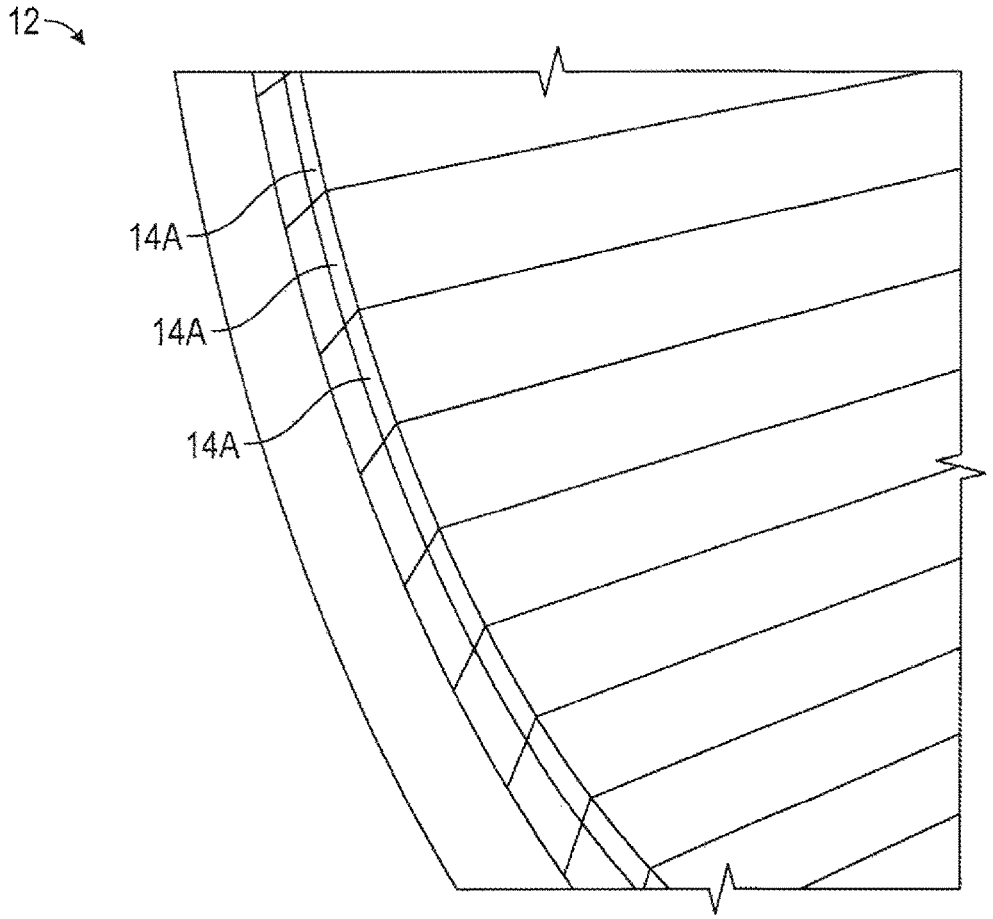
FIG. 8C is a magnified view of a section of a neck support pillow comprised of a support pillow body configured as shown in FIGS. 8AA and 8AB.
Figure 14A:
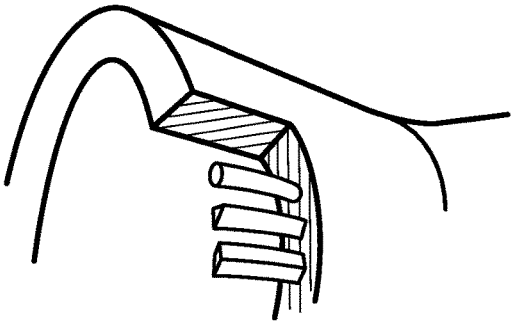
FIGS. 14A and 14B are cutaway views of support pillow bodies showing resistance cords or rods in accordance with one or more aspects of the present invention.
Figure 14B:
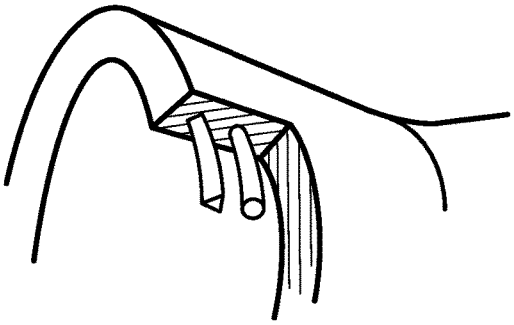

As shown in FIGS. 8C and FIGS. 14A and 14B, the support pillow body 12 may also include one or more flexible cords or rods 15 disposed within a foam layer 12 in a longitudinal or horizontal (perpendicular to the longitude axis) orientation. The flexible cords or rods 15 may be made of denser foam, which foam material may be made of rubber, elastic polymer, polyurethane, or man-made or natural based material that is flexible in nature. The cords or rods 15 may also be made of a flexible composite or polymer material, such as rubber or plastic, which is flexible and more or less rigid depending on the level of tension or resistance desired.

The flexible cords or rods 15 may be used to provide a firmer feel to the neck support pillow 10 or to help hold the shape of the neck support pillow 10.

In accordance with one embodiment, the support pillow body 12 may have a plurality of holes and or openings 31 (hereinafter openings 31) formed there-through as shown in FIG. 4E. The openings 31 may be formed to allow air to flow through the support pillow body 12 and hence the neck support pillow 10. Thus, the openings 31 may be used to increase breathability of the neck support pillow 10, to reduce sweating, and prevent the neck support pillow 10 from retaining heat when in use.

Figure 9A:
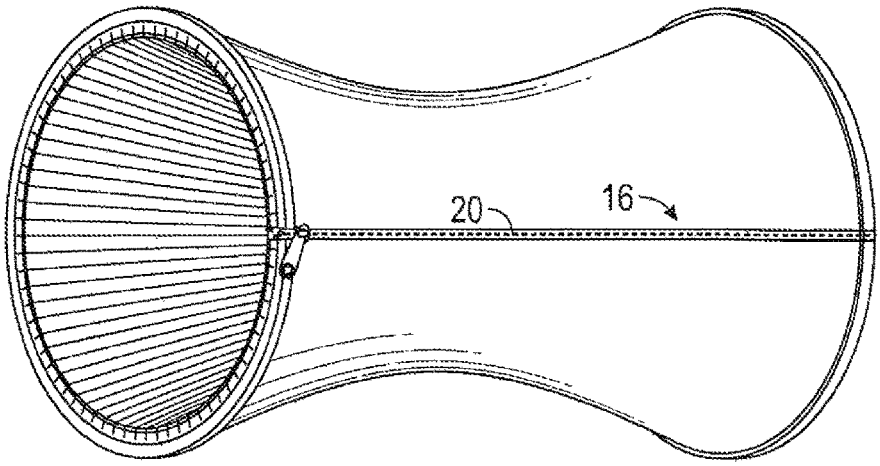
FIGS. 9A through 9I show a method for folding and storing a neck support pillow in accordance with one or more aspects of the present invention.
Figure 9B:
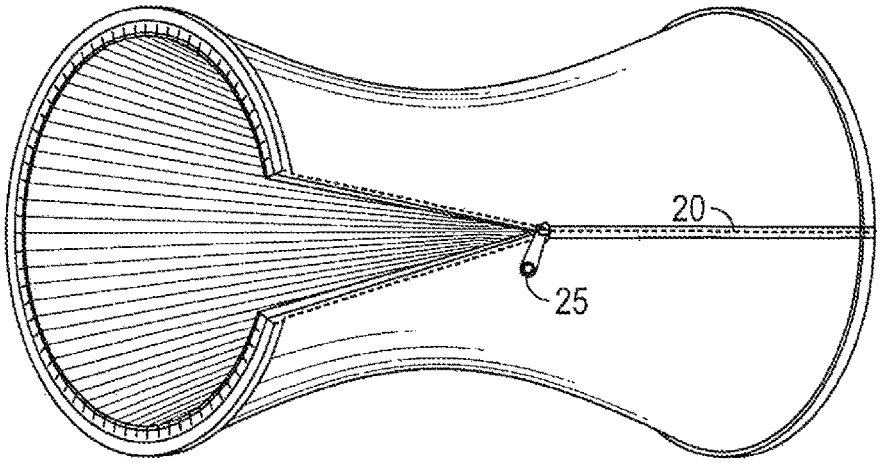

One or more fastening mechanisms 16 may be attached to the support pillow body 12. The fastening mechanisms 16 may be used to assemble the substantially planar shape of an unassembled support pillow body 12 into the tubular shaped support pillow body 12 of the neck support pillow 10 by fastening first and second edges of the support pillow body 12 to each other as shown in FIGS. 9A and 9B. While the tubular design of the assembled neck support pillow 10 may be hollow, it would be understood by one skilled in the art that an assembled neck support pillow 10 may in some embodiments be comprised of a solid foam support pillow body having varying degrees of foam density or firmness between the center and end regions.

As may be seen in FIGS. 9A through 9D, the fastening mechanism 16 may be a zipper mechanism 20. The zipper 20 may be formed of a first set of teeth 21 formed on one end of the support pillow body 12 and a second set of teeth 23 formed on a second end of the support pillow body 12. A sliding body 25 may be used to secure the first set of teeth 21 to the second set of teeth 23 to form the tubular structure of an assembled neck support pillow 10. The fastening mechanism for attaching the first and second edges of the of the support pillow body, as showing in FIGS. 9A and 9B, may also comprise temporary fasteners such as hook and loop fasteners, buttons, or snaps that may be used to fasten said first and second edges of the support pillow body 12 to each other.

Figure 13:
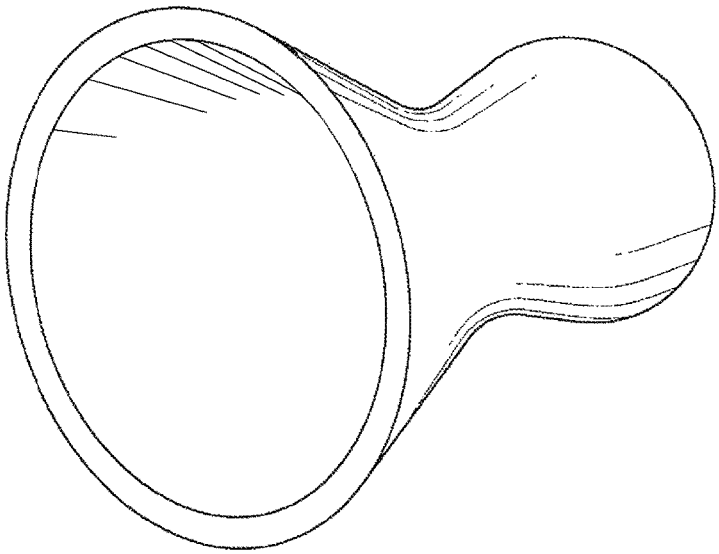
FIG. 13 shows another embodiment of a neck support pillow in accordance with one or more aspects of the present invention.

Alternatively, the support pillow body 12 may include integrated male and female connectors on the first and second connecting edges of the support pillow body. In such an embodiment, a first edge of the support pillow body 12 may have a male connector while a second end of the support pillow body 12 may have a female connector. In an assembled configuration, the male connector may be inserted into the female connector to form the tubular structure of the neck support pillow 10 as shown in FIG. 13.

Figure 10:
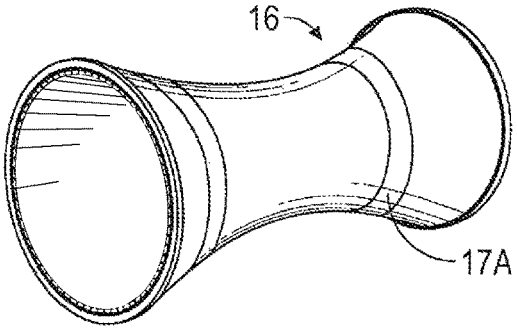
FIG. 10 is a neck support pillow in accordance with one or more aspects of the present invention.
Figure 11A:
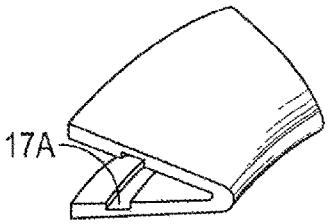
FIG. 11A through 11C are perspective views of a support pillow body showing channels that may be disposed at various positions in the support pillow body in accordance with one or more aspects of the neck support pillow of FIG. 10.
Figure 11C:
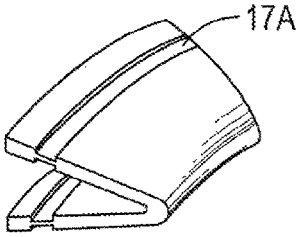
Figure 11B:
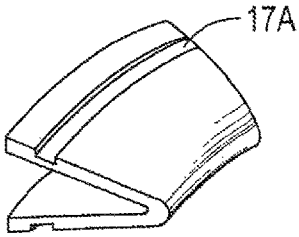
Figure 12A:
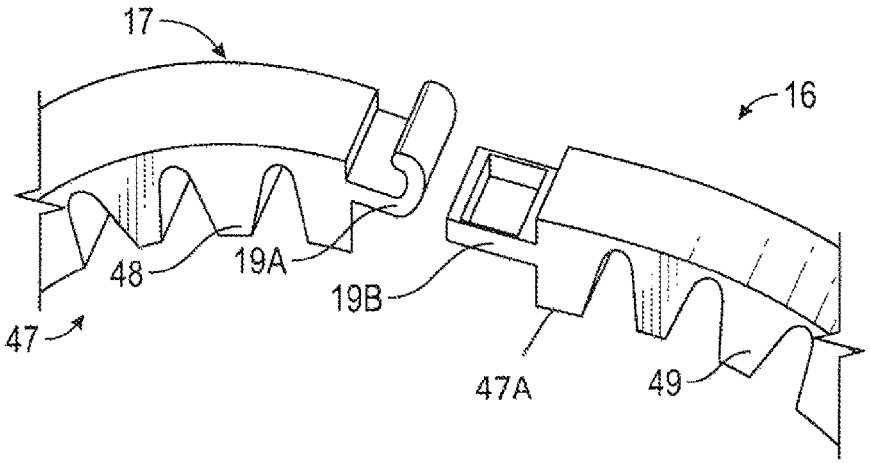
FIG. 12A is a partial perspective view of a locking strip in accordance with one or more aspects of the present invention.
Figure 12B:
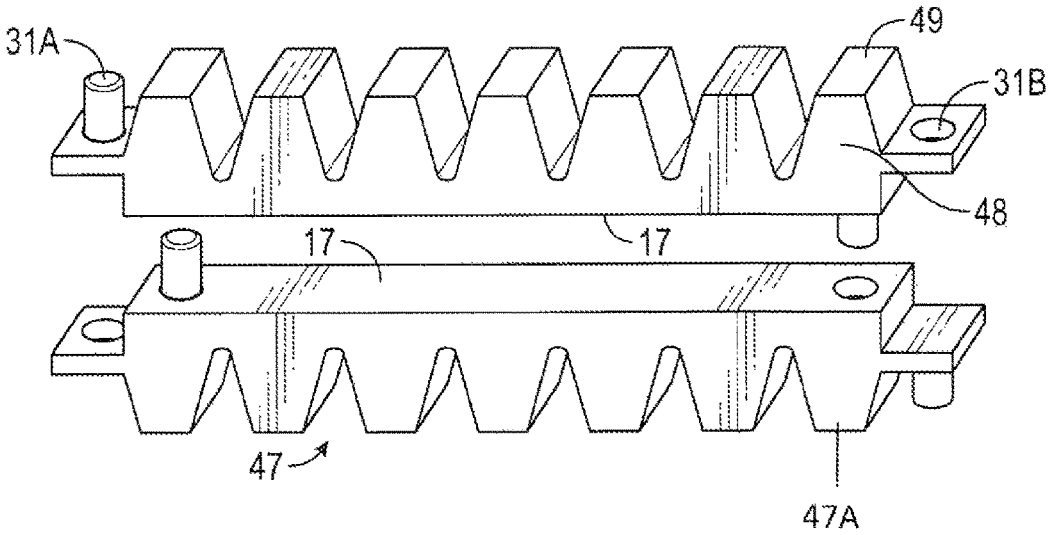
FIG. 12B is a perspective view of another embodiment of a locking strip in accordance with one or more aspects of the present invention.

Other embodiments of fastening mechanisms 16 may also be used to assemble the support pillow body 12 into the neck support pillow 12, such as those shown in FIGS. 12A and 12B. In one or more embodiments of the present invention, the fastening mechanisms 16 of FIGS. 12A and 12B may be used to assemble a support pillow body 12 as show in FIGS. 11A through 11B into a neck support pillow similar to the one shown in FIG. 10. Locking strips 17 as shown in FIGS. 12A and 12B may be disposed in a corresponding channel 17A or recess as shown in FIGS. 10 through 11B. A locking strip 17 may be placed around the neck support pillow 10 to keep the neck support pillow 10 in an assembled form. The locking strip 17 such as the one shown in FIG. 12A may include a fastening mechanism on each end of the locking strip 17. The fastening mechanism of the locking strip 17 of FIG. 12A may be used to secure the locking strip 17 around the assembled neck support pillow 10. The fastening mechanism may be a hook 19A and a loop 19B as shown in FIG. 12A, a male connector 31A and female connector 31B as shown in FIG. 12B. The above is given as an example and should not be seen in a limiting manner. Other methods of fastening the locking methods known in the art may also be used.

The locking strip 17 may be also be used to help maintain the shape of the neck support pillow 10 and increase resistance to improve neck support and comfort. Thus, the locking strip 17 may also act as a resistance device 47. The resistance device 47 may be used to prevent the neck support pillow 10 from folding inward and or collapsing when the locking strip 17 is used to assemble the neck support pillow 10. The resistance device 47 may be used to prevent the ends of the neck support pillow 10 from folding inward and or collapsing. In accordance with one embodiment, the resistance device 47 may include a plurality of teeth 47A, 49 and may be comprised of foam which is denser or firmer than the material comprising the support pillow body 12. The foam material may be made of rubber, elastic polymer, polyurethane, or man-made or natural based material that is flexible in nature. The plurality of teeth 47A, 49 may also be made of a flexible composite or polymer material such as rubber or plastic. When pressure is applied to the neck support pillow 10, each of the plurality of teeth 47A, 49 may press into adjacent teeth 47A, 49. As more pressure is applied, such as when a user moves his or her head closer to the locking strip 17, each of the plurality of teeth 47A, 49 may compress or move closer to adjacent teeth 47A, 49. Thus, as compression increases, adjacent teeth 47A, 49 help increase resistance and prevent further compression, helping prevent the ends of the neck support pillow 10 from folding too far inward and or collapsing.

Alternatively, as shown in FIG. 12B, a locking strip 17 having male and female connectors 19 may be used as a fastening mechanism 16 by connecting the end male plugs 31A and the end female plug holes 31B. The locking strip 17 as shown in FIG. 12B may also be used to secure the support pillow body in a folded position for storage by disposing it in the channels 17A on a first and second outer side of a support pillow body 12 which may be in a folded position, as shown in FIGS. 11C and 11B, and securing the two locking strip 17 sections by connecting the end male plugs 31A and the end female plug holes 31B.

Each of the locking strips 17 shown in FIGS. 12A and 12B may be used in concert with a fastener 16, such as a zipper, disposed longitudinally for securing the first and second longitudinal edges of the support pillow body 12.

Figure 15:
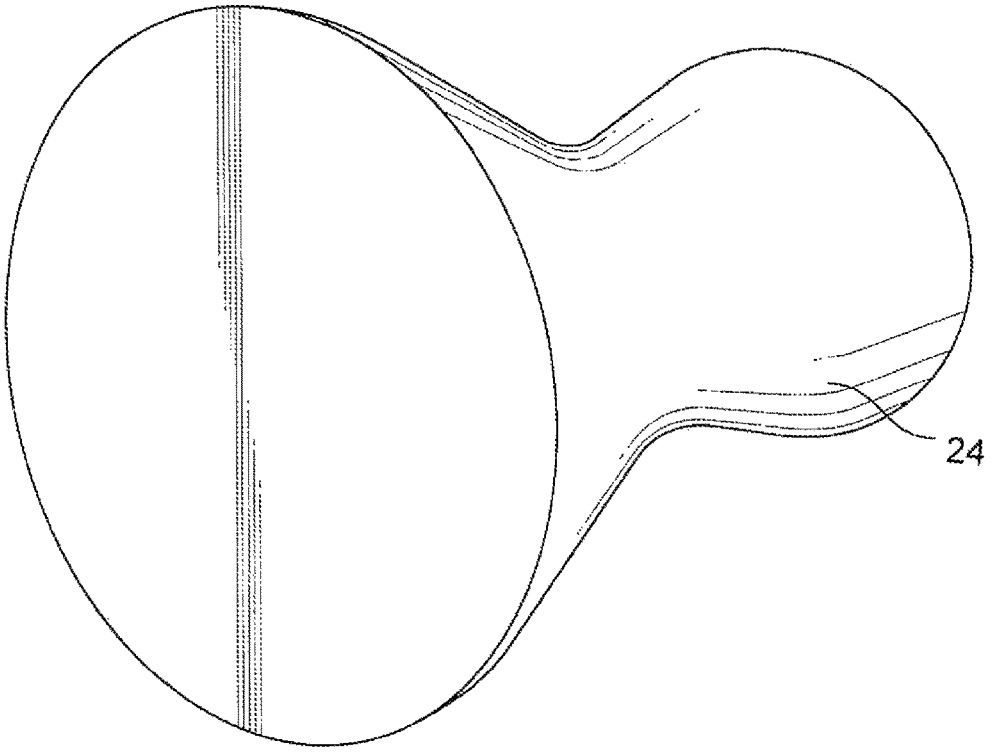
FIG. 15 is a perspective view of another embodiment of a neck support pillow in accordance with one or more aspects of the present invention.

A covering 24 may also be used to enclose the support pillow body 12 as shown in FIG. 15. The covering 24 may serve several purposes. For example, the covering 24 may serve as the fastening mechanism 16 to keep the support pillow body 12 assembled in a tubular configuration of the neck support pillow 10. Further, when stretched over the rolled up support pillow body 12, the covering 24 may be integral and or complementary for neck support. The covering 24 may also improve the texture and comfort of the neck support pillow 10 or allow for branding opportunities, such as the addition of logos. The covering 24 may also be removable to permit the covering 24 to be washed. The covering 24 may also include anti-microbial qualities to help prevent spreading of germs. The covering 24 may be made of a microfiber or similar material to improve breathability. Other types of materials may be used without departing from the spirit and scope of the present invention.

When assemble, the neck support pillow 10 may also have a collar member 32 located on each end 12A of the neck support pillow 10. The collar member 32 is designed to resist compression when the neck support pillow 10 is in an assembled configuration and pressure is applied on the neck support pillow 10. The collar member 32 may be formed of a material which is firmer than the material used to form the rest of the support pillow body 12. When the neck support pillow 10 is disassembled, the collar member 32 unrolls to a flat line dimension. The collar member 32 may be detachable or permanently attached to the neck support pillow 10.

Figure 6A:
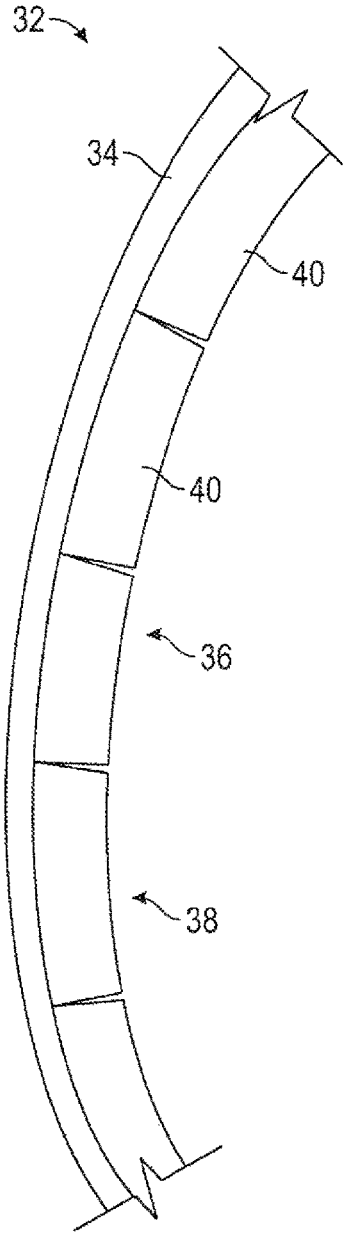
FIG. 6A is a magnified view of an end ring or collar member which may be used to regulate resistance in a neck support pillow in accordance with one or more aspects of the present invention.
Figure 6B:
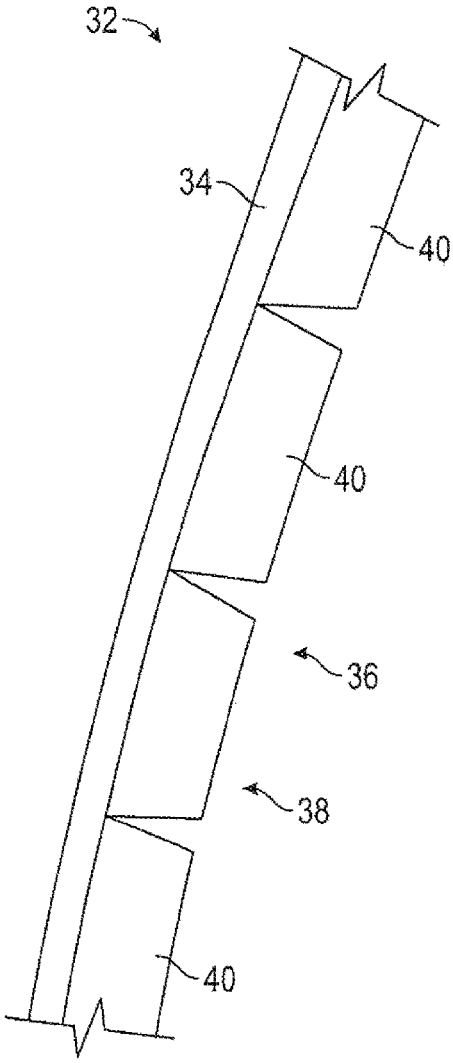
FIG. 6B is another magnified view of the end ring or collar member shown in FIG. 6A in accordance with one or more aspects of the present invention.
Figure 6C:
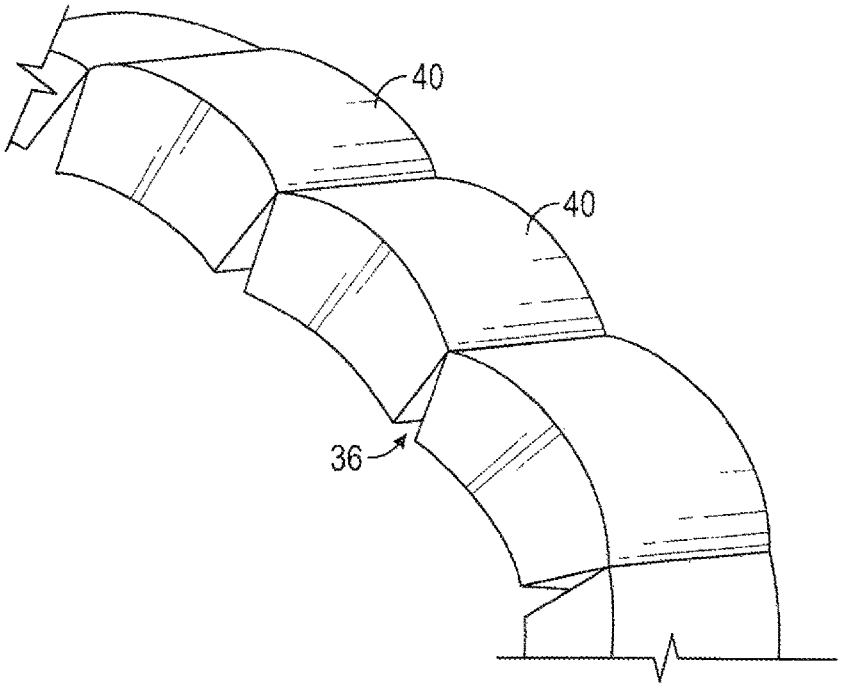
FIG. 6C is a magnified view of another embodiment of an end ring or collar member which may be used to regulate resistance in a neck support pillow in accordance with one or more aspects of the present invention.
Figure 6D:
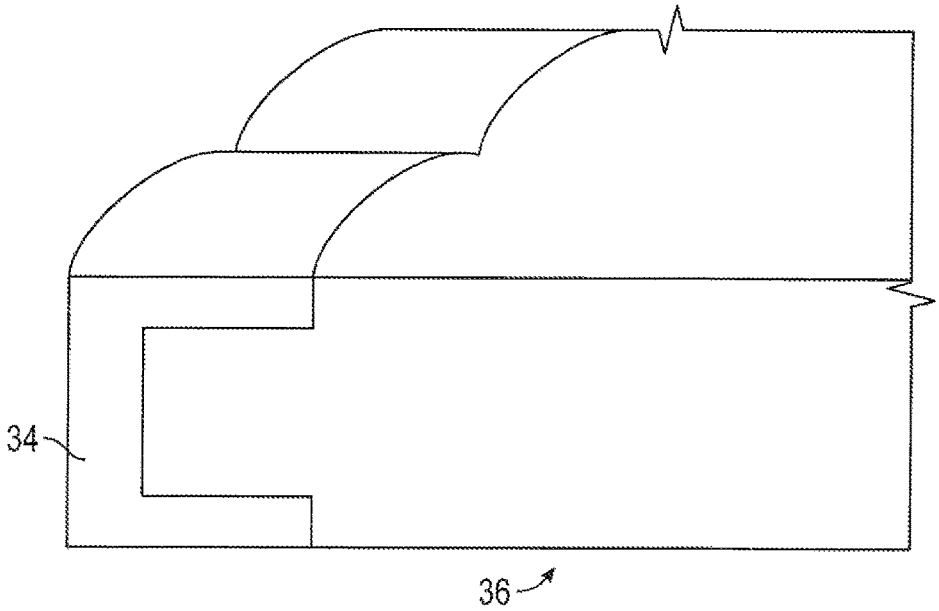
FIG. 6D is a magnified cutaway view of the end ring or collar member shown in FIG. 6C wherein the end ring or collar member is disposed on an end of a support pillow body of a neck support pillow in accordance with one or more aspects of the present invention.

One embodiment of a collar member 32 is shown in FIGS. 6A and 6B and another embodiment of the collar member 32 is shown in FIGS. 6C and 6D. As may be seen in the FIGS. 6A-6D, the collar member 32 may be comprised of a frame member 34. The frame member 34 may be used to attach the collar member 32 to the outer perimeter of each end of the neck support pillow 10. Attached to the frame member 34 is a resistance device 36. The collar member may act as a resistance device or regulator to help prevent the neck support pillow 10 from folding to far inward and or collapsing when in use. The collar member 32 may be used to prevent the ends of the neck support pillow 10 from folding too far inward and or collapsing.

In accordance with one embodiment, the collar member 32 may be a foam material which is firmer than the material comprising the support pillow body 12. The foam material may be made of rubber, elastic polymer, polyurethane, or man-made or natural based material that is flexible in nature. The collar member 32 may also be made of a flexible composite or polymer such as rubber or plastic. The collar member 32 may be divided into a plurality of sections or collar teeth 40. As may be seen in the FIG. 6A, when the neck support pillow 10 is assembled, each of the plurality of collar teeth 40 may press against adjacent collar teeth 40. As more pressure is applied, such as when a user moves his or her head closer to the edge of the neck support pillow 10, each of the plurality collar teeth 40 may further press against adjacent collar teeth 40. Since the plurality of collar teeth 40 are made of material that is denser or firmer than the material used to make the support pillow body, the plurality of collar teeth 40 increase resistance and reduce potential compression of the first and second ends 10A of the assembled neck support pillow. As the first and second ends 10A of the neck support pillow 10 compress and the plurality of the collar teeth 40 begin to press against each other, the increased support may help prevent the ends 10A of the neck support pillow 10 from folding too far inward and or collapsing.

In an alternative embodiment, the collar member 32 may be directly attached to the outer perimeter of each end of the neck support pillow 10. In this embodiment, the collar member 32 may be integrated with the support pillow body as shown in FIG. 6D.

Figure 7:
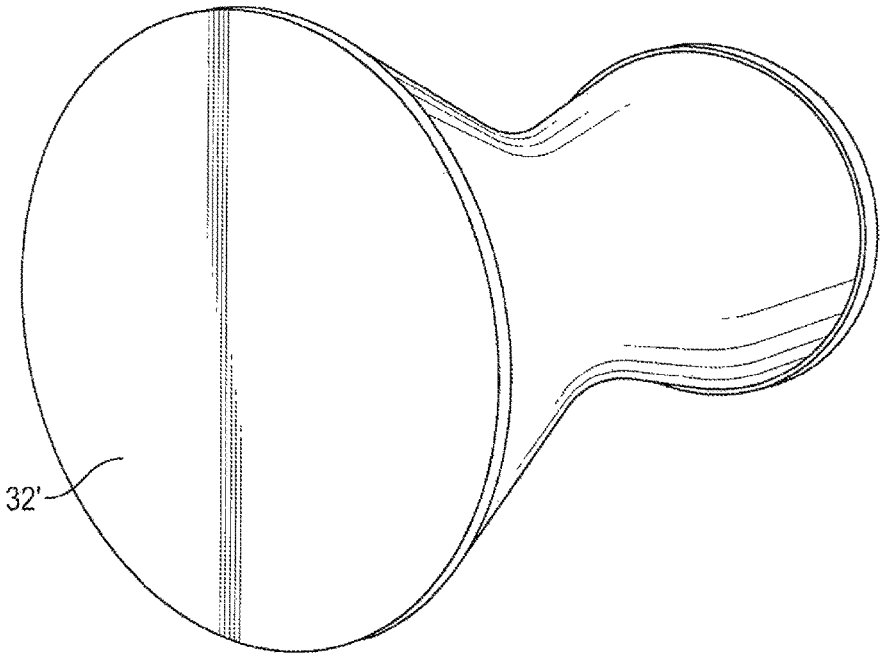
FIG. 7 is an end perspective view of a neck support pillow having a solid end cap in accordance with one or more aspects of the present invention.

While FIGS. 6A-6D shows the collar member 32 as being configured as a ring, this should not be seen in a limiting manner. The collar member 32 may take on different configurations without departing from the spirit and scope of the present invention. For example, FIG. 7 shows a collar member 32 configured as a continuous end cover.

The neck support pillow 10 of the present invention may be used when assembled by placing the neck support pillow 10 behind the neck of a user 11 and the using disposing his or her neck near the center of the neck support pillow 10. In a substantially hourglass-shaped embodiment of the present invention, the user may dispose his or her neck near the center of a depression 30 of the contoured hourglass shape as shown in FIG. 2. As the user 11 rest his or her neck on the neck support pillow 10 and applies more pressure to the neck support pillow, compression near the center of the neck support pillow 10 may help actuate the first and second ends 10A of the neck support pillow 10 to move towards each other in the direction of the center line that is perpendicular to the length of the neck support pillow 10. As pressure from the user's neck or head is applied to the center region of the neck support pillow 10, the neck support pillow 10 may tend to envelope the back and sides of the user's neck, thus helping support the head from a side to side displacement.

Figure 9C:
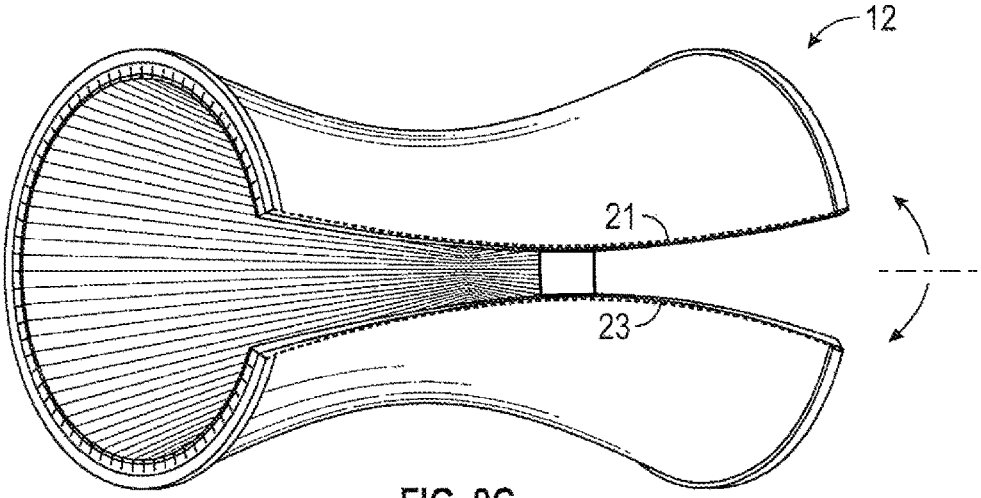
Figure 9D:
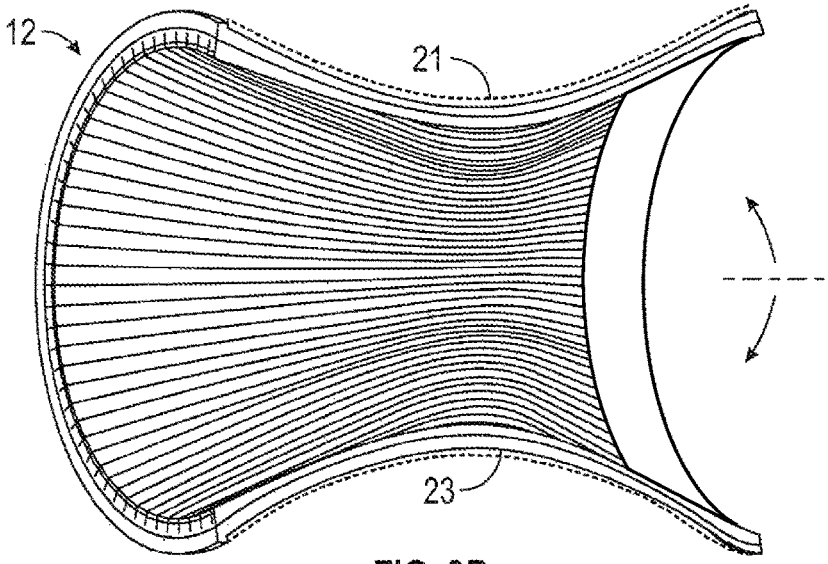
Figure 9E:
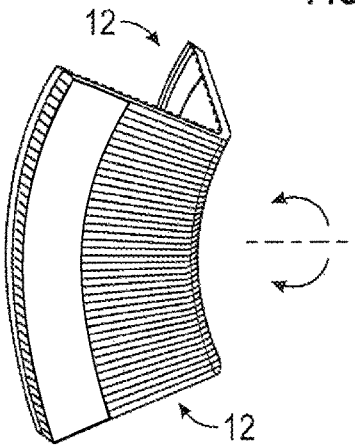
Figure 9F:
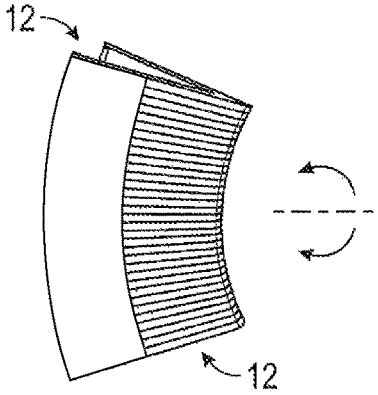

Referring now to FIGS. 9A-9I, a method is disclosed for storing a neck support pillow 10 and for disassembling and preparing a neck support pillow 10 for storage. When the user desires to store the neck support pillow 10, the neck support pillow 10 may be disassembled by unfastening the temporary fastening mechanisms 16 that attach the first and second attachable edges of the support pillow body as shown in FIGS. 9A through 9C. For example, the user may unzip the zipper mechanism 20, or in the case of buttons or snaps may unbutton or unsnap them so that the first and second attachable edges of the support pillow body are detached from each other. The neck support pillow 10 may then be folded as show in FIGS. 9D through 9G. A neck support pillow in accordance with the present invention may be configured to allow the user to fold a contoured hourglass shaped neck support pillow 10 to a substantially flat or planar body.

As shown in FIGS. 9D through 9G, the neck support pillow 10 may be folded into a position for storage by folding the support pillow body 12 so that the outer side of the neck support pillow 10 folds against itself and the inside of the neck support pillow is exposed as two sides of a single folded support pillow body 12.

Figure 9G:
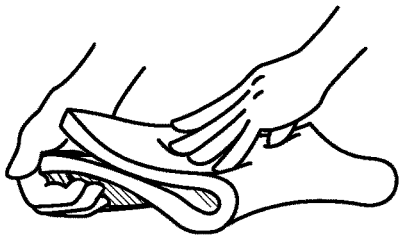
Figure 9H:
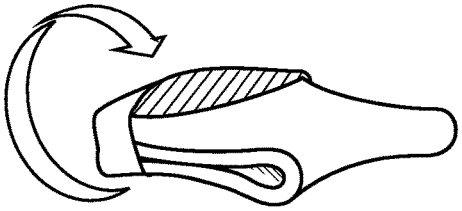
Figure 9I:
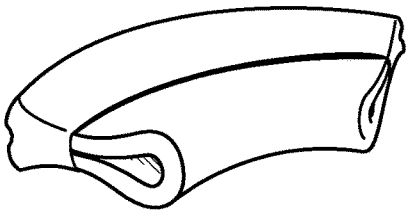

As shown in FIGS. 9C through 9F, the support pillow body 12 may include an envelope like flap on a first side of the folded neck support pillow 10 configured so that the flap may be pulled over a second side of the folded neck support pillow 10 as shown in FIGS. 9G through 9I. The support pillow body 12 may then be easily stored as a substantially flat structure which may save storage space. The flap when pulled over the folded support pillow body 12 helps secure and maintain the support pillow body 12 in a folded position.

Alternatively, a folded neck support pillow 10, as shown in FIGS. 11C or 11B, may be secured and maintained in a substantially flat or planar configuration by securing first and second locking strips 17, as shown in FIG. 12B, on each side of the folded neck support pillow wherein the first and second locking strips 17 are disposed in a recess or channel 17A and the locking strips 17A are fastened to each other using male connector plugs 31A and female connector plugs 31B as shown in FIG. 12B. It is understood that other fastening means known to one skilled in the art may be used to connect the locking strips 17.

Other fastening means such as hook and loop material, buttons, snaps, ties, or other fastening means available to one skilled in the art may also be used to secure and maintain the disassemble neck support pillow 10 in a folded and substantially flat or planar configuration.

To reassemble the neck support pillow 10, user may simply reverse the disassembly steps shown in FIGS. 9A-9I. It should be understood that the neck support pillow 10 may also be configured in other manners or to other shapes without departing from the spirit and scope of the present invention. For example, the neck support pillow may be a single continuous solid neck support pillow. The single continuous solid neck support pillow 10 may be comprised of foam wherein the density and or firmness of the foam may be greater at the ends and reduced near the center region. The foam material may be made of rubber, elastic polymer, polyurethane, or man-made or natural based material that is flexible in nature. This embodiment may be more suitable for home use where portability may be less of a concern.

Alternatively, the neck support pillow 10 may be configured so that the shell or wall of the support pillow body 12 is thicker so that when the support pillow body 12 is assembled to form the neck support pillow 10, the neck support pillow 10 is not hollow or tubular or so that any hollow space is reduced. This neck support pillow 10 having a thicker shell or wall wherein it is substantially non-hollow may also be comprised of polyurethane foam or other flexible and durable foam wherein the density and or firmness of the foam may be greater at the ends and reduced near the center region. Similarly, the neck support pillow 12 may also be comprised of a support pillow body 12 wherein the wall of the wall or shell of the support pillow body 12 is a single continuous wall that has not been cut or otherwise separated longitudinally.

The outer surface of the neck support pillow 10 may be textured to provide additional support in concert with effects of the compression resistant architecture of the support pillow body 12. A fabric cover may be stretched over or otherwise cover the support pillow body 12 and may vary in thickness and texture for a desired preference for comfort. Additionally, the textured surface of the neck support pillow may improve airflow for breathability to reduce sweating and help maintain the neck and head cool.

It should also be understood that while the present invention is described as a neck support pillow 10, it may be used on other areas of the body without departing from the spirit and scope of the present invention.

There is thus disclosed a novel neck support pillow and method for storing the same. While the invention has been particularly shown and described with reference to preferred embodiments thereof, it will be appreciated by those skilled in the art that numerous changes may be made to the present invention without departing from the scope of the claims.

What is claimed is:

1. A pillow for supporting the head and neck of a user comprising:

a flexible support pillow body forming a tubular shape, wherein a hollow interior space is formed in the tubular shape;

a depression formed in a center region which is disposed between a first end and a second end of the support pillow body;

a first end region associated with the first end of the support pillow body; and a second end region associated with the second end of the support pillow body;

wherein the center region is less resistant to compression than the first end region and the second end region of the support pillow body.

2. The pillow of claim 1, wherein the support pillow body is configured in an hourglass-shape.

3. The pillow of claim 2, wherein the support pillow body comprising a flexible foam.

4. The pillow of claim 3, wherein the support pillow body further comprises a plurality of layers.

5. The pillow of claim 4, having an outer layer and at least one inner layer, wherein the outer layer is comprised of a foam that is more pliable than a material comprising the at least one inner layer.

6. The pillow of claim 5, wherein an innermost layer of the at least one inner layer is comprised of a plurality of ribbed strips.

7. The pillow of claim 6, wherein each of the plurality of ribbed strips is trapezoidal in shape.

8. The pillow of claim 1, wherein the tubular support pillow body includes a first longitudinal edge and a second longitudinal edge capable of connecting to each other.

9. The pillow of claim 8, further comprising a temporary fastening mechanism configured for connecting the first longitudinal edge to the second longitudinal edge of the support pillow body.

10. The pillow of claim 9, wherein the temporary fastening mechanism comprises a zipper system.

11. The pillow of claim 9, wherein the temporary fastening mechanism comprises a locking strip.

12. The pillow of claim 9, further comprising a first collar member disposed at the first end of the support pillow body and a second collar member disposed at the second end of the support pillow body.

13. The pillow of claim 1, wherein the support pillow body includes one or more integrated resistance cords.

14. The pillow of claim 13 wherein the one or more resistance cords are comprised of foam having greater resistance than a foam substantially comprising a great portion of a wall of the support pillow body.

15. A pillow for supporting the head and neck of a user comprising:

a tubular support pillow body having a single continuous wall and a hollow interior space formed in the body, wherein the support pillow body has a first conical half and a second conical half; and a depression disposed between the first conical half and the second conical half, the depression capable of supporting a user's neck.

16. A method for assembling a travel pillow comprising:

selecting a support pillow body having a first longitudinal edge and a second longitudinal edge, wherein the first longitudinal edge and the second longitudinal edge may be connected to form a tubular support pillow body, wherein a hollow interior space is formed in the tubular support pillow body, wherein a depression formed in a center region of the support pillow body; and connecting the first longitudinal edge to the second longitudinal edge of the support pillow body using a temporary fastening mechanism to form a tubular support body pillow.

17. The method of claim 16, wherein the temporary fastening mechanism is a zipper device.

18. The method of claim 16, wherein the support pillow body includes a plurality of channels suitable for receiving locking strips and wherein the temporary fastening mechanism is a plurality of locking strips.

* * * * *